US006347596B1

(12) United States Patent
Koeberlein et al.

(10) Patent No.: US 6,347,596 B1
(45) Date of Patent: Feb. 19, 2002

(54) DEVICE FOR THE TRANSPORTATION OF A LENGTH OF CLOTH

(75) Inventors: Dieter Koeberlein, Grosseibstadt; Martin Schnaus, Bad Koenigshofen-Eyershausen, both of (DE)

(73) Assignee: Texpa Maschinenbau GmbH & Co. KG (DE)

( * ) Notice: Subject to any disclaimer, the term of this patent is extended or adjusted under 35 U.S.C. 154(b) by 0 days.

(21) Appl. No.: 09/651,985

(22) Filed: Aug. 30, 2000

(30) Foreign Application Priority Data

Jun. 5, 2000 (DE) ..... 200 09 773

(51) Int. Cl.[7] ..... D05B 35/02; D05B 27/10
(52) U.S. Cl. ..... 112/141; 112/304
(58) Field of Search ..... 112/304, 141, 112/306, 307, 311, 320; 198/577, 604, 803.3

(56) References Cited

U.S. PATENT DOCUMENTS 4,621,585 A * 11/1986 Ball et al. ..... 112/304
4,624,198 A * 11/1986 Beam et al. ..... 112/141
4,856,439 A * 8/1989 O'Neal et al. ..... 112/307 X
4,962,712 A * 10/1990 Sotome et al. ..... 112/307
5,152,235 A * 10/1992 Goto et al. ..... 112/304

* cited by examiner

*Primary Examiner*—Ismael Izaguirre
(74) *Attorney, Agent, or Firm*—McGlew and Tuttle, P.C.

(57) ABSTRACT

A device (1) for the transportation of a length of cloth (10) is disclosed. The device has a slide face (7) on which the length of cloth (10), laid out flat, can be moved, and at least two conveying belts (**140–14*d*, 17), each disposed so that they run in the direction of conveyance (13, 16). The first conveying belt (17) is disposed in front of the second conveying belt (140–14*d*) in the direction of conveyance (13, 16). For the purpose of io the transmission of a conveying motion, at least the second conveying belt (140–14*d*) can be brought into contact with the length of cloth (10) from above. In the transition region between a first conveying belt (17) and a second conveying belt (140–14*d*), there is provided at least one pressure element (20, 21) which, pressing the length of cloth (10) against the slide face (7), can be brought into contact with the length of cloth (10) from above, at least in regions. This pressure element (20, 21) can be moved between two end positions at a feed rate which corresponds substantially to the speed of conveyance of the length of cloth (10**).

20 Claims, 2 Drawing Sheets

DEVICE FOR THE TRANSPORTATION OF A LENGTH OF CLOTH

FIELD OF THE INVENTION

The invention concerns a device for the transportation of a length of cloth, with a slide face on which the length of cloth, laid out flat, can be moved, and at least two conveying belts, each disposed so that they run in the direction of conveyance, the first conveying belt being disposed in front of the second conveying belt in the direction of conveyance and, for the purpose of the transmission of a conveying motion, at least the second conveying belt being able to be brought into contact with the length of cloth from above.

BACKGROUND OF THE INVENTION

Devices of this kind are used, for example, where there is a need to handle or transport lengths of cloth which are laid out flat, for example, in order to transport the lengths of cloth from one processing station to a subsequent one, or for transportation within the processing stations. Provided in the device is an appropriately dimensioned slide face, for example a sufficiently smooth table top on which the length of cloth can be moved. For the purpose of transmitting to the length of cloth the force required for advancing the length of cloth in this slide region, use can be made of conveying belts which are disposed so that they run in the direction of conveyance and can be brought into contact with the length of cloth from above. As a result, the length of cloth can thus be pressed against the slide face by the conveying belt contacting it from above, the conveying motion of the conveying belt being transmitted to the length of cloth due to the frictional forces acting between the conveying belt and the length of cloth. In total, therefore, the conveying belt performs two functions, namely, the transmission of the conveying motion to the length of cloth, as the first, and the securing of the position of the length of cloth, particularly of a substantially fold-free, flat laying-out, as the second. Known in the art, for the purpose of being able to convey lengths of cloth along conveyance paths of, in principle, any length, is the practice of combining together several conveying belts, these being disposed serially in the direction of conveyance. The conveying belts before the conveying belts in the slide region can also contact the length of cloth from above and operate on the same principle as those belts. It is also conceivable, however, that the conveying belts before the slide region contact the length of cloth from below and convey it forward by carrying it from below. The use of several serially disposed conveying belts is also particularly advantageous when an installation for processing the lengths of cloth is constructed from several individual stations, with at least one conveying belt for conveyance of the length of cloth then being present in each individual station and the individual stations being disposed in series in such a way that the lengths of cloth can be conveyed forward from one conveying belt to the next.

A disadvantage of the known devices with several serially disposed conveying belts, of which at least one can be brought into contact with the length of cloth from above, is the fact that the position of the length of cloth is not secured in the transition region between the conveying belts. This is because, in the transition region between the conveying belts, none of the serially disposed conveying belts comes into contact with the length of cloth, so that the layout of the length of cloth can alter in an unwanted manner between the conveying belts. This risk exists particularly when the length of cloth already has folds in certain regions as a result of production, as is the case, for example, when a frilled band is provided on the edges of the length of cloth.

SUMMARY AND OBJECTS OF THE INVENTION

The object of the present invention is to provide a new device for the transportation of a length of cloth.

According to the invention, a device is provided for the transportation of a length of cloth. The device has a slide face on which the length of cloth, laid out flat, can be moved, and at least two conveying belts, each disposed so that they run in the direction of conveyance. The first conveying belt is disposed in front of the second conveying belt in the direction of conveyance. For the purpose of the transmission of a conveying motion, at least the second conveying belt is able to be brought into contact with the length of cloth from above. Particularly according to the invention, between the serially disposed conveying belts there is provided a pressure element which can itself be brought into contact with the length of cloth from above, pressing the length of cloth against the slide face, so that the position of the length of cloth can be secured by the pressure element in the transition region between the conveying belts. This pressure element can be moved between two end positions at a feed rate which corresponds to the conveying speed of the length of cloth. As a result, a relative movement between the pressure element and the length of cloth during the conveyance of the length of cloth by the conveying belts can thus be substantially precluded. As soon as the pressure element is brought into contact with the length of cloth from above, this ensures that the region of the length of cloth which is contacted below the pressure element can be conveyed forward in the desired position froze the preceding conveying belt into the subsequent conveying belt.

According to a preferred embodiment, the extent of the pressure element in the direction of conveyance corresponds to at least half the distance between the conveying belts in the direction of conveyance.

In the conveyance of a length of cloth from one conveying belt to the subsequent conveying belt, it is the side edges facing towards the direction of conveyance that are particularly liable to disturbance. For example, if the side edge of a length of cloth projects slightly upwards after leaving the first conveying belt, this can impair the clean feeding-in of the length of cloth into the subsequent conveying belt. It is therefore particularly advantageous if the pressure element is disposed in such a way that it can be brought into contact in the region of a side edge of the length of cloth, so that disturbances can be prevented in the transfer of this side edge from one conveying belt to the next.

Essentially, for the purpose of securing the position of the length of cloth, it is obviously sufficient if in each case at least one of the conveying elements, namely, either one of the serially disposed conveying belts or the pressure element, is brought into contact in a region. A greater process reliability is achieved, however, if, in its end positions, the pressure element in each case has at least a slight overlap with the serially disposed conveying belts. For this purpose, the pressure element can be disposed in such a way, for example, that a lateral offset is created between the pressure element and the serially disposed conveying belts, so that, in the end positions, the pressure element can come to lie next to the conveying belts, at least in the region of its ends.

Essentially, lengths of any type of cloth can be handled by means of a device according to the invention. The use of a device according to the invention is particularly advantageous in the case of lengths of cloth which are formed from two strips of material, the strips of material being joined together by a seam running substantially perpendicular to the direction of conveyance of the conveying belts. In the handling or transportation of such lengths of cloth, the pressure element can be advantageously disposed in such a way that the first strip of material can be brought into contact with the pressure clement. In the region of the transition between the two strips of material, in particular, disturbances can occur in the transfer of the length of cloth from the front conveying belt to the conveying belt behind it. If the first strip of material is pressed against the slide face by the pressure element during transition, disturbance can be precluded to a large extent.

Particularly liable to disturbance is the conveyance of lengths of cloth in which one of the strips of material is joined to the other strip of material by means of a seam with the formation of a plurality of folds. This is the case, for example, when a frilled band is sewn on to a strip of material with a flat surface. Due to the plurality of folds of the second strip of material, disturbances can easily occur when the strip of material comprising the folds is fed in. These disturbances can be prevented if this strip of material is pressed flat against the slide face by the pressure element during the feed-in between the conveying belt and the slide face. The pressure element presses the folds of the strip of the material together in the region of the feed-in between the slide face and the conveying belt, so that the strip of material does not project upwards in this region and can thus be drawn in cleanly. In addition, the pressure element can prevent an unwanted alteration of the position of the side edges of the length of cloth in the region of the folded strip of material. This is of benefit particularly if the length of cloth is to be transported from a preceding work station to a hemming device. The position of the side edges to be hemmed is secured by the conveying belts in the preceding work station. If the length of cloth is transferred to the conveying belts of the hemming device without securing of the position of the side edges to be hemmed in the region of the folded strip of material, there is a risk, due to the folding of the strip of material, that the side edge to be hemmed will move in an undesired manner and thus cause disturbances in the hemming device.

In order that the position of, in particular, strips of material comprising folds can be reliably secured upon transfer, the extent of the pressure element in the direction of conveyance can correspond at least to the width of the strip of material comprising the folding. This ensures, in particular, that the position a side edge of a length of cloth to be hemmed can be secured along the entire strip of material comprising the folding during the transfer between the conveying belts.

According to a preferred embodiment of the invention, the first conveying belt is disposed in such a way that it comes into contact solely with one of the strips of material in the conveying movement.

It is particularly advantageous if there is provided in the device a cutting device by means of which the length of cloth can be cut from an endless material. It is furthermore advantageous if there is provided in the device at least one hemming device by means of which a hem can be produced on an edge of the length of cloth. It is self-evident that the device can be composed of several individual work stations, for example, for cutting and hemming the length of cloth.

Since securing the position of an edge of the length of cloth to be hemmed is of particular importance in the transfer between two conveying belts due to the fact that only a cleanly aligned side edge can be cleanly hemmed, it is particularly advantageous if in each case a pressure element can be brought into contact with the length of cloth in the region of a side edge which is to be hemmed, so that, upon transfer between two serially disposed conveying belts, this side edge does not undergo any unwanted change of position.

Essentially, it is sufficient if, for the transportation of the length of cloth, at least one conveying belt in each case can be brought into contact with the length of cloth from above. The width of this conveying belt must be selected so that reliable transportation of the length of cloth is assured. It is particularly advantageous, however, if at least one further conveying belt, running in the direction of conveyance, is in each case disposed in parallel to a conveying belt. In the transportation of the length of cloth, these adjacently disposed parallel conveying belts then work together in that in each case the force required for transporting the length of cloth is transmitted by the individual conveying belts, distributed over the width of the length of cloth. Thus, through combining several conveying belts of essentially the same construction, each of a relatively small width, it is possible to assure the transportation of lengths of cloth of any required width.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
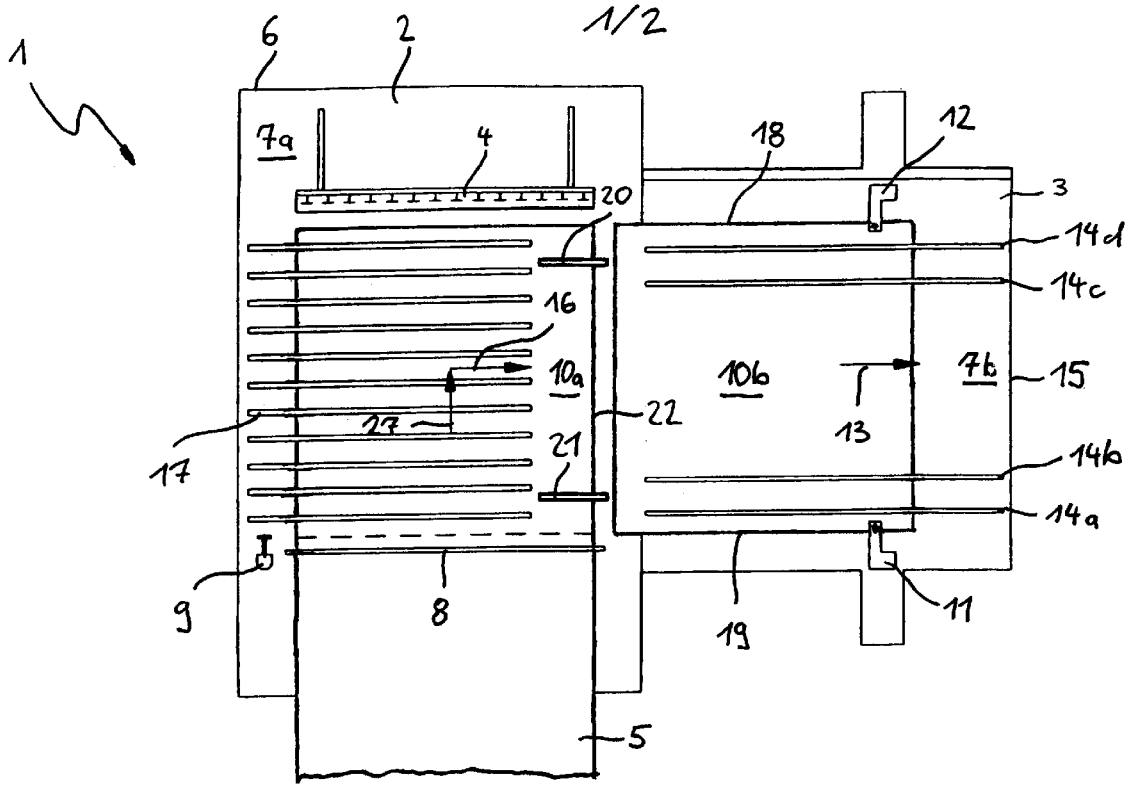
FIG. 1 is a top view showing a device for cutting and hemming a length of cloth in a first operating state.

Referring to the drawings in particular, FIG. 1 shows a device 1 for cutting and subsequent hemming of lengths of cloth. This device 1 consists, essentially, of a work station 2 for cutting the lengths of cloth and a work station 3 for hemming of the lengths of cloth.

An endless material 5 can be drawn into the work station 2 from a roll of cloth, not depicted, in the direction of the movement arrow 27 by means of a gripper device 4. Here, the endless material 5, laid out in flat form, makes contact from above with the top of a work table 6 which is fashioned as a slide face 7*a*. As soon as the gripper device 4 has attained the desired end position, the gripper device 4 is released and the position of the endless material 5 is secured by means of a fixing strip 8. A cutting device 9 is then moved transversely relative to the side edge of the endless material 5, separating off a length of cloth 10*a* from the endless material 5.

For the subsequent hemming of the lengths of cloth 10, a hemming device 11 and 12, each with a sewing machine, is provided in the work station 3 in the region of each of the side edges of the lengths of cloth 10. For the purpose of hemming the length of cloth 10*b*, the length of cloth is conveyed forward into the work station 3, along the movement arrow 13, so that the hemming devices 11 and 12 can hem the side edges of the length of cloth 10*b* over its entire length. For the purpose of transporting the length of cloth 10*b* in the direction of the movement arrow 13, there are provided in the work station 3 four endlessly revolving conveying belts 14*a* to 14*d*, which are disposed so that they run in parallel to one another and can contact the length of cloth 10*b* from above. Also provided in the work station 3, corresponding to the construction of the work station 2, is a work table 15, the top surface of which is fashioned as a slide face 7*b*. As soon as the conveying belts 14*a* to 14*d* contact the length of cloth 10*b* from above, the length of cloth 10*b* is pressed between the slide face 7*b* and the conveying belts 14*a* to 14*d* at a defined contact pressure, so that the conveying motion of the conveying belts 14*a* is to 14*d* can be transmitted to the length of cloth 10*b*. In the conveying motion of the length of cloth 10*b* in the direction of the movement arrow 13, the length of cloth 10*b* slides over the slide face 7*b* substantially free of friction.

For the purpose of transporting the length of material 10*a* in the direction of the movement arrow 16, as is necessary for transferring the length of cloth 10*a* from the work station 2 into the work station 3, there are provided in the work station 2 a total of 11 conveying belts 17, disposed in parallel to one another, the functioning of which corresponds to the functioning of the conveying belts 14*a* to 14*d*. In order to secure as precisely as possible the position of the side edges 18 and 19 to be hemmed upon the transfer of a length of cloth 10 from the work station 2 into the work station 3 and to prevent disturbances in the transfer of the lengths of cloth 10 from the conveying belts 17 on to the conveying belts 14, there are provided in the device 1 two pressure elements 20 and 21 which can be brought into contact with the lengths of cloth 10 from above, in the region of the side edges 18 and 19. In the operating state depicted in FIG. 1, the pressure elements 20 and 21 are in the first end position, the front edge 22 of the length of cloth 10*a* making contact below the pressure elements 20 and 21 when the pressure elements 20 and 21 are in this end position.

Figure 2:
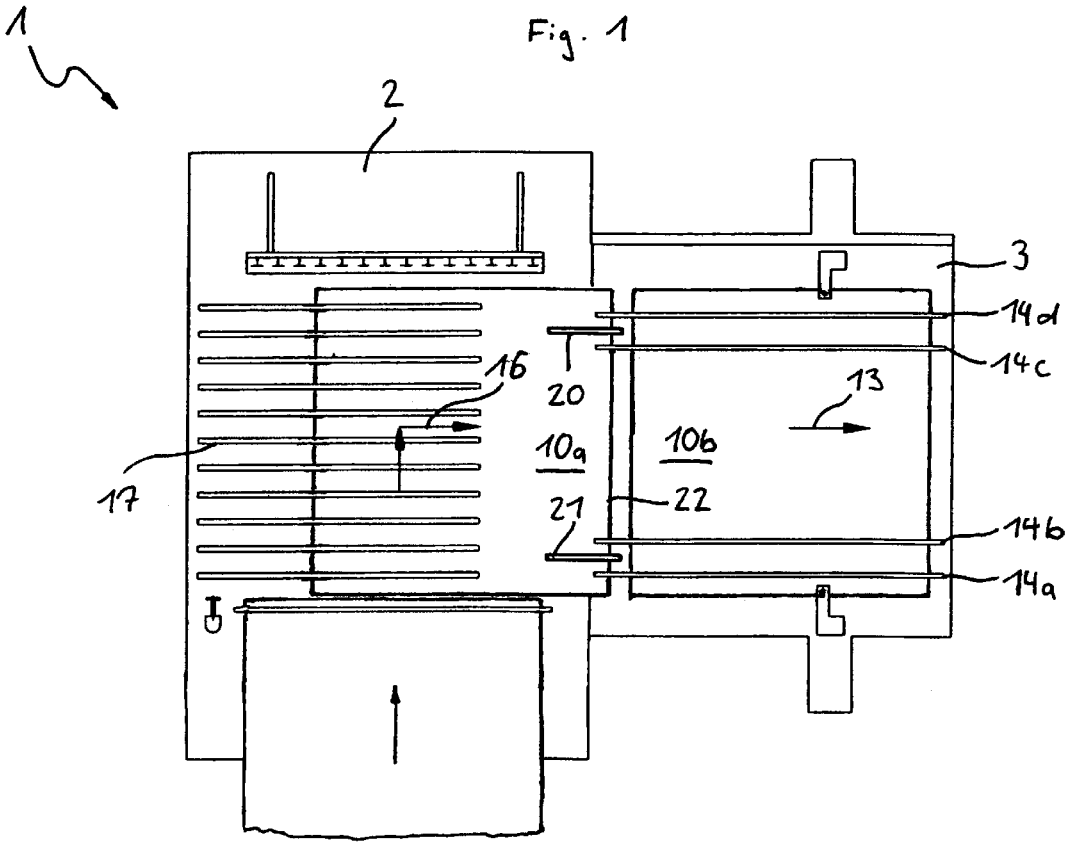
FIG. 2 is a top view showing the device according to FIG. 1 in a second operating state.

The functioning of the pressure elements 20 and 21 during the transfer of the length of cloth 10*a* from the work station 2 into the work station 3 is explained by the operating state depicted in FIG. 2. It can be seen that the length of cloth 10*a* can be conveyed forward by the conveying belts 17 in the direction of the movement arrow 16 and thus transferred from the work station 2 to the work station 3. At the same time, the length of cloth 10*b* is conveyed forward by the conveying belts 14*a* to 14*d*, in the direction of the movement arrow 13, to a subsequent conveying device, not depicted, in order to clear the space in the work station 3 for the length of cloth 10*a*. While the length of cloth 10*a* is being conveyed in the direction of the movement arrow 16 by the conveying belts 17, the pressure elements 20 and 21, which contact the length of cloth 10*a* from above, move in parallel to the direction of motion 13 or 16 at a forward feed rate which corresponds to the speed of conveyance of the length of cloth 10*a*. By this means, the position of the front edge 22 is secured in the region of the front corners of the length of cloth 10*a* upon transfer from the work station 2 to the work station 3, so that the side edges 18 and 19 can be transferred in the desired position.

In the operating state depicted in FIG. 2, the pressure elements 20 and 21 have attained their second end position. In this end position, the front edge 22 has already been drawn in by the conveying belts 14*a* to 14d, so that the position of the side edges 18 and 19 is secured in the region of the front edge 22 by the conveying belts 14*a* and 14*d*. Following attainment of this end position, the pressure elements 20 and 21 are raised from the length of cloth 10*a* and thus taken out of contact. Due to the overlapping of the pressure elements 20 and 21 with the conveying belts 14*a* to 14*d* in the second end position, it is ensured that the position of the front edge 22 is secured throughout the transfer of the length of cloth 10*a*.

Figure 3:
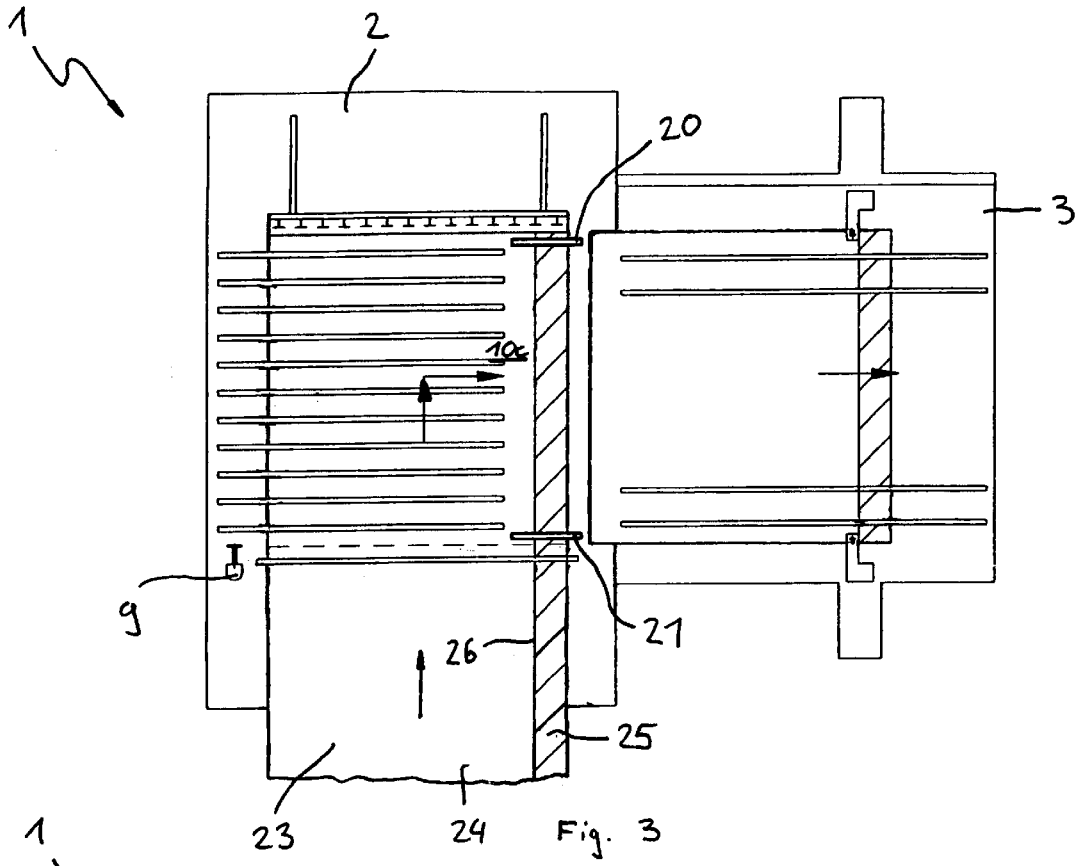
FIG. 3 is a top view showing the device according to FIG. 1 in a third operating state.
Figure 4:
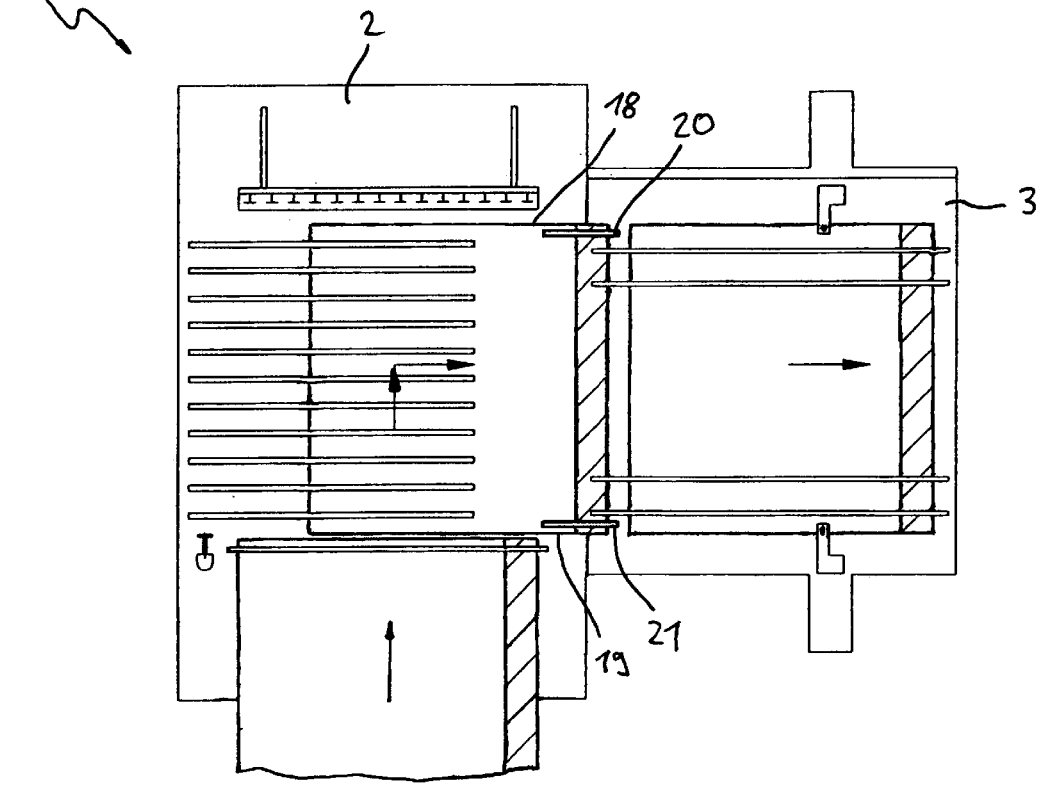
FIG. 4 is a top view showing the device according to FIG. 1 in a fourth operating state.

FIG. 3 and FIG. 4 show the device 1 in the processing of another endless material 23 in two operating states, which correspond substantially to the operating states depicted in FIG. 1 and FIG. 2. It can be seen that the endless material 23 is formed from two strips of material 24 and 25 which are joined together along a seam 26. Following cutting by means of the cutting device 9, the resultant length of cloth 10*c* is to be transferred from the work station 2 to the work station 3, in accordance with the functioning method depicted in FIG. 1 and FIG. 2, and seamed in the work station 3. Positionally correct transfer of the length of cloth 10*c* presents problems particularly if, as depicted schematically in FIG. 3, the strip of material 25 is joined to the strip of material 24 by a seam with the formation of a plurality of folds. This is necessary, for example, if the strip of material 25 is intended to form a frilled band on the strip of material 24.

In order to ensure that the side edges 18 and 19 are transferred to the work station 3 in the correct position in spite of the folding in the region of the strip of material 25, the pressure elements 20 and 21 are disposed in such a way that the strip of material 25 can make contact under the pressure elements 20 and 21 during the entire transfer of the length of cloth 10*c* from the work station 2 to the work station 3.

While a specific embodiment of the invention has been shown and described in detail to illustrate the application of the principles of the invention, it will be understood that the invention may be embodied otherwise without departing from such principles.

What is claimed is:

1. A device for the transportation of a length of cloth, the device comprising:

a slide face, the length of cloth, laid out flat, being moveable on said slide face;

a first conveying belt;

a second conveying belt, each conveying belt being disposed running in a same direction of conveyance, said first conveying belt being disposed in front of said second conveying belt in the direction of conveyance and, for the purpose of the transmission of a conveying motion, at least said second conveying belt being able to be brought into contact with the length of cloth from above;

a pressure element in a transition region between said first conveying belt and said second conveying belt, said pressure element for pressing the length of cloth against the slide face, and being brought into contact with the length of cloth from above, at least in regions, and being movable between two end positions at a feed rate which corresponds substantially to a speed of conveyance of the length of cloth.

2. A device according to claim 1, wherein the extent of said pressure element in a direction of conveyance corresponds to at least half a distance between said first conveying belt and said second conveying belt in a direction of conveyance.

3. A device according to claim 2, wherein said pressure element is disposed so that it has at least a slight overlap, in the direction of conveyance, with the first conveying belt in a first said end position and so that it has at least a slight overlap, in the direction of conveyance, with the second conveying belt in a second said end position.

4. A device according to claim 2, wherein the length of cloth is formed from at least two strips of material which are joined along a seam running substantially perpendicular to the direction of conveyance of the conveying belts, the pressure element being disposed so that the first strip of material can be brought into contact with the pressure element.

5. A device according to claim 1, wherein said pressure element is disposed so that it is brought into contact in the region of side edge of a length of cloth.

6. A device according to claim 1, wherein said pressure element is disposed so that it has at least a slight overlap, in the direction of conveyance, with the first conveying belt in a first said end position and so that it has at least a slight overlap, in the direction of conveyance, with the second conveying belt in a second said end position.

7. A device according to claim 1, wherein the length of cloth is formed from at least two strips of material which are joined along a seam running substantially perpendicular to the direction of conveyance of the conveying belts, the pressure element being disposed so that the first strip of material can be brought into contact with the pressure element.

8. A device according to claim 7, wherein the first strip of material is joined to the second strip of material by a seam, with the formation of a plurality of folds, and the first strip of material is pressed flat against the slide face, at least in regions, by the pressure element.

9. A device according to claim 7, wherein the extent of the pressure element in the direction of conveyance corresponds at least to the width of the first strip of material.

10. A device according to claim 7, wherein said first conveying belt is disposed in such a way that it can be brought into contact solely with the second strip of material.

11. A device according to claim 10, further comprising:

a hemming device for producing a hem on an edge of the length of cloth.

12. A device according to claim 11, the pressure element is brought into contact with the length of cloth in a region of a side edge to be hemmed.

13. A device according to claim 1, further comprising:

a material supply;

a cutting device for cutting a length of cloth from said material supply.

14. A device according to claim 1, further comprising:

a hemming device for producing a hem on an edge of the length of cloth.

15. A device according to claim 1, the pressure element is brought into contact with the length of cloth in a region of a side edge to be hemmed.

16. A device according to claim 1, further comprising:

another conveying belt running parallel to the direction of conveyance, said another conveying belt being adjacent to the first and/or the second conveying belt.

17. A device for transportation of cloth, the device comprising:

a slide face slidably supportable of the cloth;

a first conveying belt arranged adjacent said slide face and slidable of the cloth across said slide face in a conveying direction;

a second conveying belt arranged adjacent said slide face and arranged spaced from said first conveying belt by a transition region, said second conveying belt being slidable of the cloth across said slide face in a same said conveying direction;

a pressure element arranged in said transition region and being movable against the cloth on said slide face, said pressure element also being movable between first and second end positions at a feed rate which corresponds substantially to a speed of conveyance of the cloth by one of said conveying belts.

18. A device in accordance with claim 17, wherein:

said second end position of said pressure element overlaps with a position of said second conveying belt on said slide face.

19. A device in accordance with claim 18, wherein:

said first end position of said pressure element overlaps with a position of said first conveying belt on said slide face.

20. A device in accordance with claim 17, wherein:

said conveying belts and said slide face are arranged to movably position the cloth between said conveying belts and said slide face;

said pressure element moves from said first end position to said second end position in said conveying direction.

* * * * *